US005907282A

United States Patent [19]

Tuorto et al.

[11] Patent Number: 5,907,282

[45] Date of Patent: May 25, 1999

[54] PHYSIOLOGY MONITORING SLEEP PREVENTION SYSTEM

[75] Inventors: Chris W. Tuorto; Anthony Fernandez, both of Boca Raton; Michael M. Anthony, Coral Springs, all of Fla.

[73] Assignees: Chris W. Turto, Mesa, Ark.; Anthony Fernandez, Adventura, Fla.

[21] Appl. No.: 08/848,215

[22] Filed: Apr. 29, 1997

[51] Int. Cl.[6] ..... G08B 21/00

[52] U.S. Cl. ..... 340/576; 340/439; 340/575; 340/689

[58] Field of Search ..... 340/576, 575, 340/689, 439

[56] References Cited

U.S. PATENT DOCUMENTS

| | | | |
|---|---|---|---|
| 5,353,013 | 10/1994 | Estrada | 340/576 |
| 5,488,353 | 1/1996 | Kawakami et al. | 340/575 |
| 5,488,354 | 1/1996 | Colvin | 340/576 |
| 5,568,127 | 10/1996 | Bang | 340/576 |
| 5,682,144 | 10/1997 | Mannik | 340/576 |

*Primary Examiner*—Glen Swann

*Attorney, Agent, or Firm*—Oltman, Flynn & Kubler

[57] ABSTRACT

A sleep detection and alarm system includes a sensor for sensing physiological changes in a user indicating the onset of sleep, an alarm, and an alarm activation mechanism connected to the sensor for sounding the alarm upon detection of the changes by the sensor to awaken the user. The sensor preferably includes a wrist band, an instrument housing mounted to the wrist band and containing a power source, a microprocessor, a piezoelectric crystal for sensing pressure variations between the user wrist and the wrist band, and a mechanism for feeding electronic information in the form of an analog signal to the microprocessor for processing and selectively sounding the alarm. The system preferably additionally includes a filtering mechanism for filtering the analog signals before they reach the microprocessor for removing sudden variations and non-sinusoidal components of repetitive heart and blood stream sounds, so that only continuously varying signals are sensed and analyzed. The sensor preferably additionally or alternatively to the piezoelectric crystal includes a microphone for sensing sounds generated by the user heart to determine the user heart rate, and a skin conductivity sensor for measuring the amount of sweat generated by the user skin adjacent to the housing.

14 Claims, 10 Drawing Sheets

PHYSIOLOGY MONITORING SLEEP PREVENTION SYSTEM

BACKGROUND OF THE INVENTION

1. Field of the Invention

The present invention relates generally to the field of automobile and hazardous activity safety devices. More specifically the present invention relates to a system for awakening a user who is beginning to fall asleep, including means for sensing physiological changes indicating sleep and means for sounding an alarm upon detection of these changes. The system is intended for use during driving, work, piloting, boating and other potentially hazardous activities, and in the home, hospital and other areas where a person sometimes must stay awake.

2. Description of the Prior Art

There have long been stimulant drugs such as caffeine for keeping a person awake and alert for an extended time. A problem with these substances is that they are often addictive. Another problem is that the user still eventually begins to fall asleep. Should the user begin to sleep while operating an automobile, for example, without his or her awareness, nothing may intervene to alert him or her until a life-threatening accident has begun to unfold. There have also been devices for detecting the onset of sleep and sounding an alarm to awaken the user. An example is found in U.S. Pat. No. 5,402,109, issued to Mannik, et al., on Mar. 28, 1995. Mannik, et al, reflects light off the user eye and monitors the intensity of the reflected light. Interruption of the reflected light intensity caused by blinking of the eyelid sounds an alarm. A problem with Mannik, et al., is that the scattered reflected light can cause ambiguous results. Headlamps of on-coming vehicles cast a broad spectrum of light ranging from ultraviolet to near infra-red and can produce false alarms.

It is thus an object of the present invention to provide a sleep prevention system which is drug-free and otherwise safe.

It is another object of the present invention to provide such a system which alerts the user as soon as the physiological indicators of sleep appear.

It is still another object of the present invention to provide such a system which operates reliably with minimal numbers of false alarms.

It is finally an object of the present invention to provide such a system which is relatively inexpensive to manufactures easy to install and suitable for use in many environments and circumstances.

SUMMARY OF THE INVENTION

The present invention accomplishes the above-stated objectives, as well as others, as may be determined by a fair reading and interpretation of the entire specification.

A sleep detection and alarm system is provided including a sensor for sensing physiological changes in a user indicating the onset of sleep, an alarm, and an alarm activation mechanism connected to the sensor for sounding the alarm upon detection of the changes by the sensor to awaken the user.

The sensor preferably includes a wrist band, an instrument housing mounted to the wrist band and containing a power source, a microprocessor, a piezoelectric crystal for sensing pressure variations between the user wrist and the wrist band, and a mechanism for feeding electronic information in the form of an analog signal to the microprocessor for processing and selectively sounding the alarm. The system preferably additionally includes a filtering mechanism for filtering the analog signals before they reach the microprocessor for removing sudden variations and non-sinusoidal components of repetitive heart and blood stream sounds, so that only continuously varying signals are sensed and analyzed. The sensor preferably additionally or alternatively to the piezoelectric crystal includes a microphone for sensing sounds generated by the user heart to determine the user heart rate, and a skin conductivity sensor for measuring the amount of sweat generated by the user skin adjacent to the housing.

A sleep detection and alarm system is further provided, including a mechanism for detecting closure of an eyelid of a user for a certain length of time, an alarm, and a mechanism for sounding the alarm upon detection of eyelid closure for the certain length of time. The mechanism for detecting closure of an eyelid preferably includes a headband, a sound wave conduit, a sound wave emitter and receiver structure secured to the headband adjacent to one user eye including an ultra-sonic sound wave emitter including an emitter cone and an emitter wave guide for directing sound waves received through the conduit in focused waves toward the user eye and eyelid, and a receiver cone and a receiving wave guide, where the sound waves are reflected off the user eye and eyelid and received by the receiver cone and a receiving wave guide, and where the reflected sound wave is transmitted back to a mechanism for analysis through the conduit.

The mechanism for analysis is preferably a module including a power plug for connection to a power source, a piezoelectric crystal and coil for creating a continuous stream of ultrasonic pulses, and a microprocessor for analyzing reflected sound signals and selectively sounding the alarm. The sound waves may alternatively be light waves.

A sleep detection and alarm system is further provided, including a torso mounting structure and a mechanism for removably securing the torso mounting structure relative to the user torso, a head mounting structure and a mechanism for removably securing the head mounting structure relative to the user head, a pivot detection mechanism detecting forward pivoting of the head mounting structure relative to the torso mounting structure of a certain extent, and an alarm operationally connected to the pivot detection mechanism for sounding an alarm when the pivot detection mechanism detects forward pivoting of the head mounting structure relative to the torso mounting structure of the certain extent. The system preferably additionally includes a hinge structure pivotally interconnecting the torso mounting structure and the head mounting structure, permitting the head mounting structure to pivot forwardly relative to the torso mounting structure as the user head tilts forwardly relative to the user torso.

The head mounting structure preferably includes a head band and head band base pivot structure. The torso mounting structure preferably includes a chest support plate for resting on the user chest and a neck plate extending upwardly from and connected to the chest support plate. The pivot detection mechanism preferably includes a switch secured to the neck plate in a position to be contacted and thereby operated by the head mounting structure as the head mounting structure pivots forwardly with the user head.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
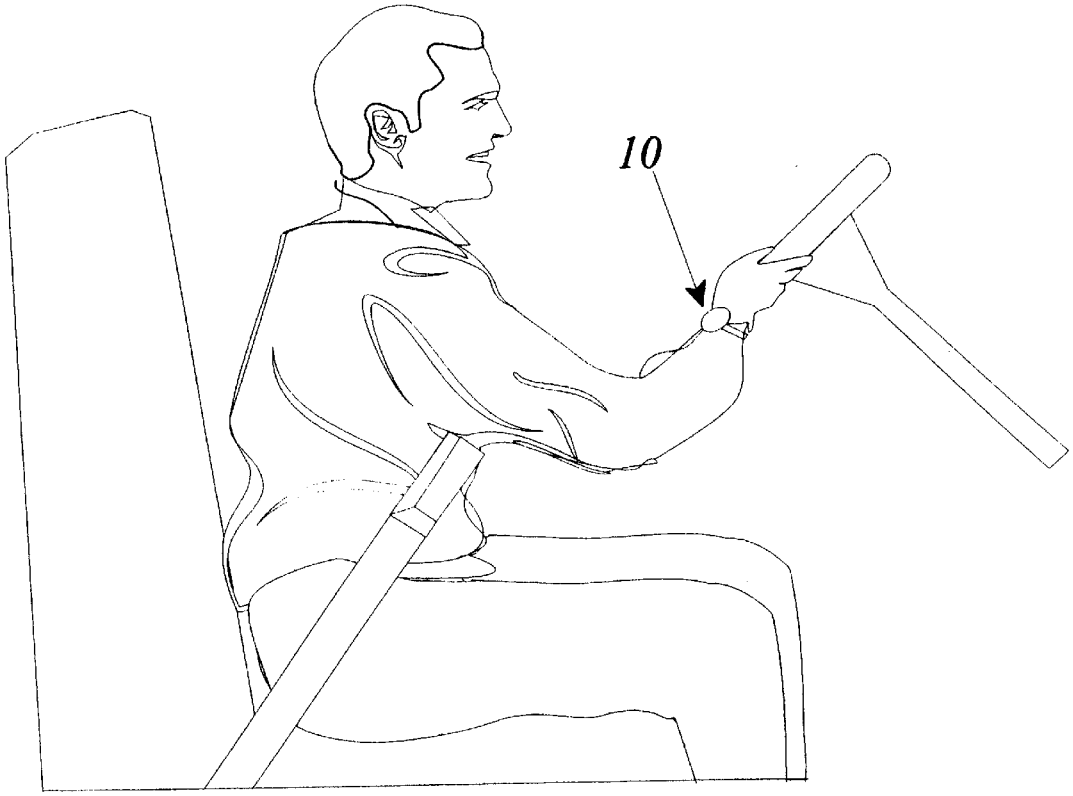
FIG. 1 is a side view of a system user sitting in a vehicle and wearing the wrist band first embodiment.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

The System Generally

Figure 2:
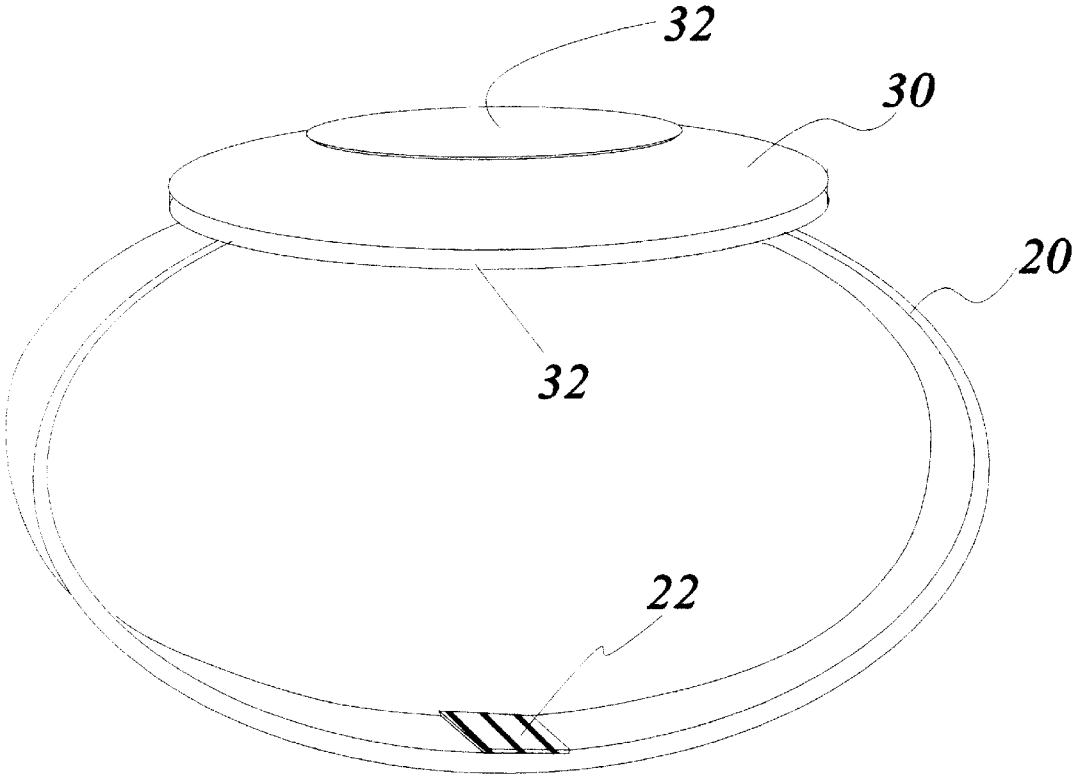
FIG. 2 is perspective view of the first embodiment.
Figure 3:
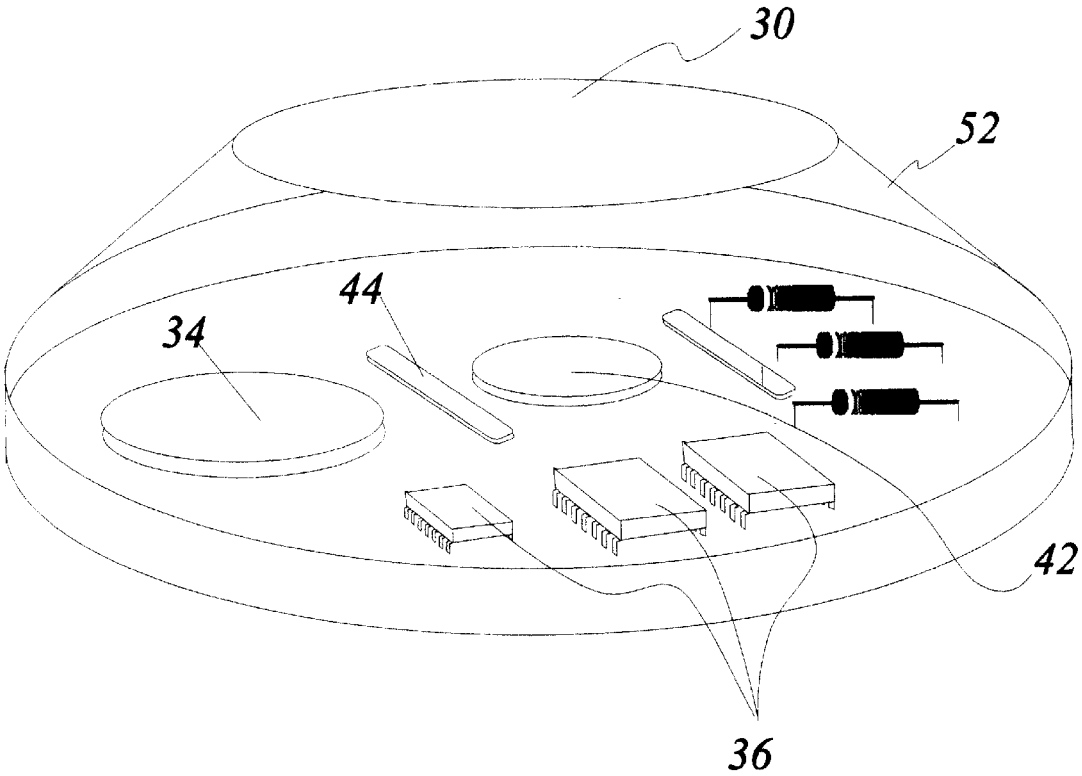
FIG. 3 is a perspective view of the wrist band housing of the first embodiment with the upper shell portion removed to reveal the various components within the housing.
Figure 4:
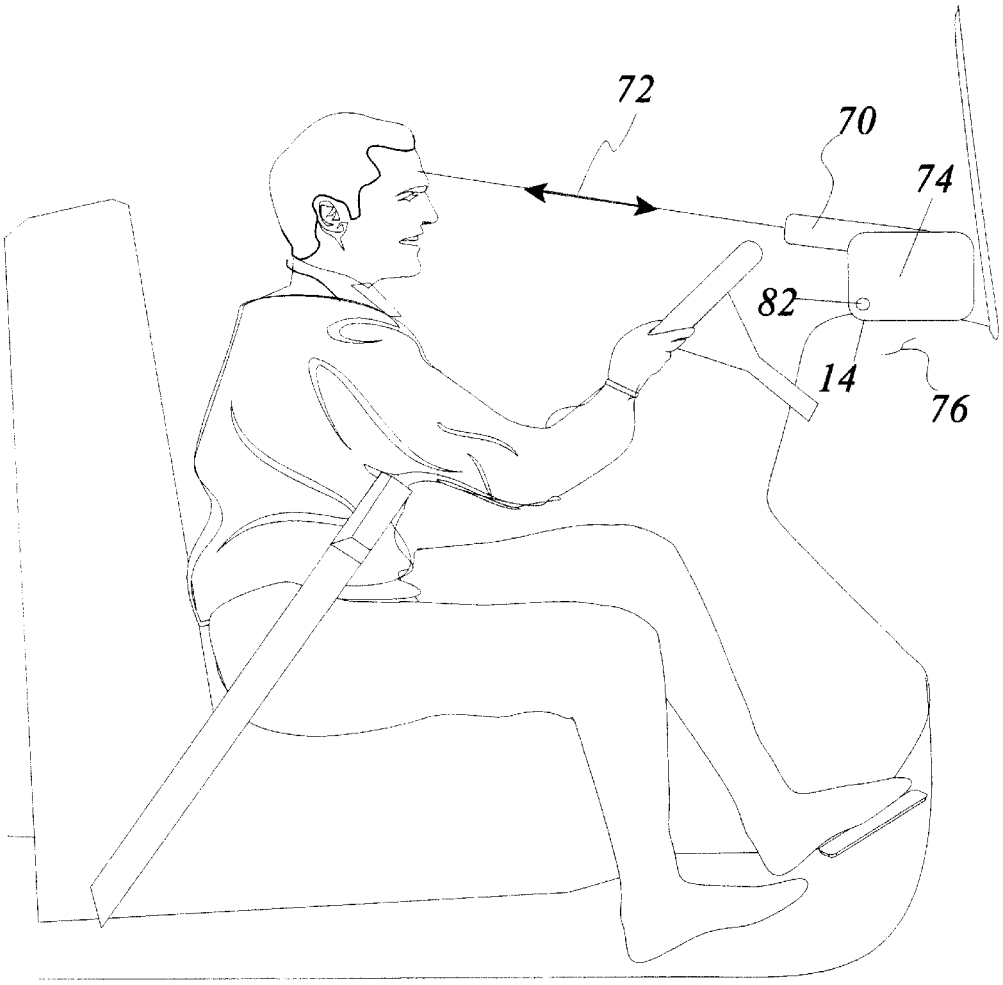
FIG. 4 is a side view of a system user sitting in a vehicle equipped with the laser beam generating second embodiment, and showing the laser beam striking the user forehead.
Figure 5:
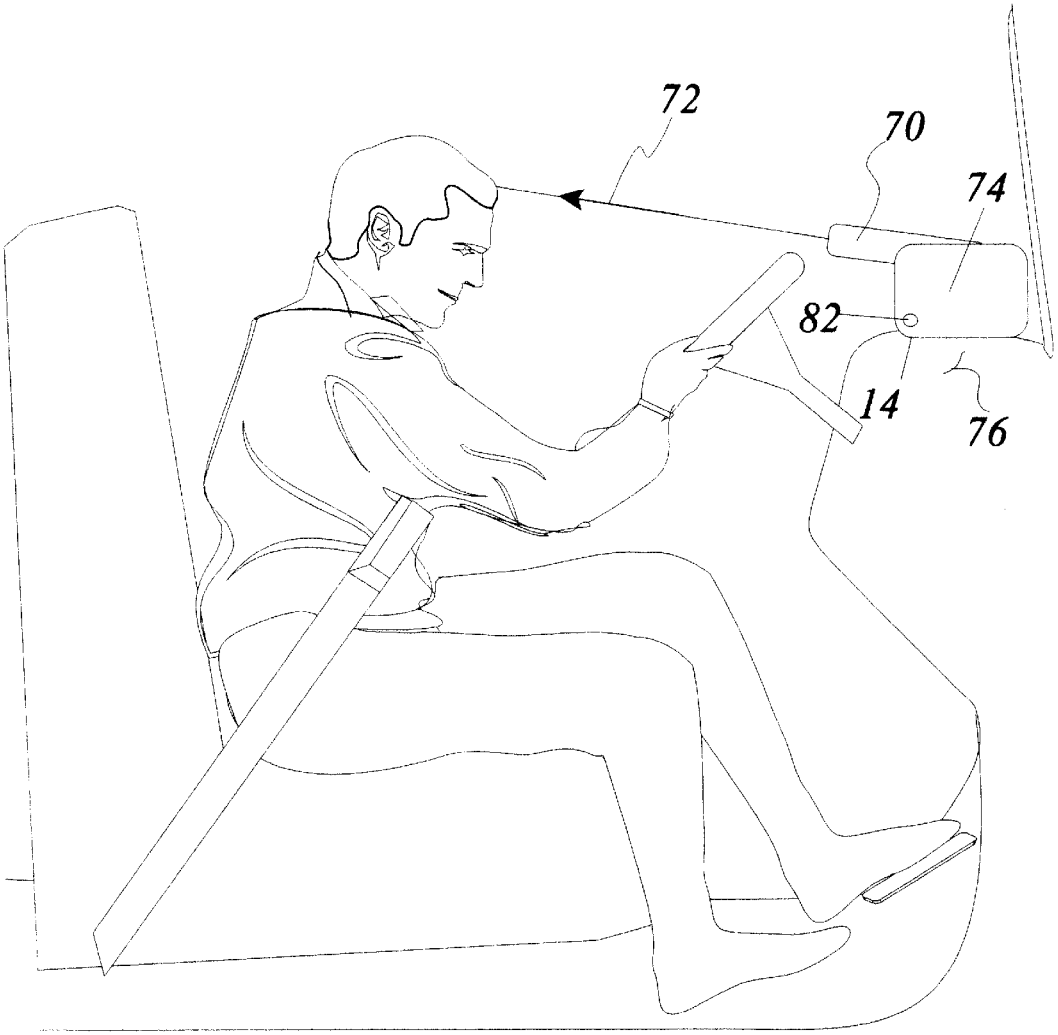
FIG. 5 is view as in FIG. 4, except that the head of the system user is tilted forward from sleepiness and the laser beam is striking the hair of the user.
Figure 6:
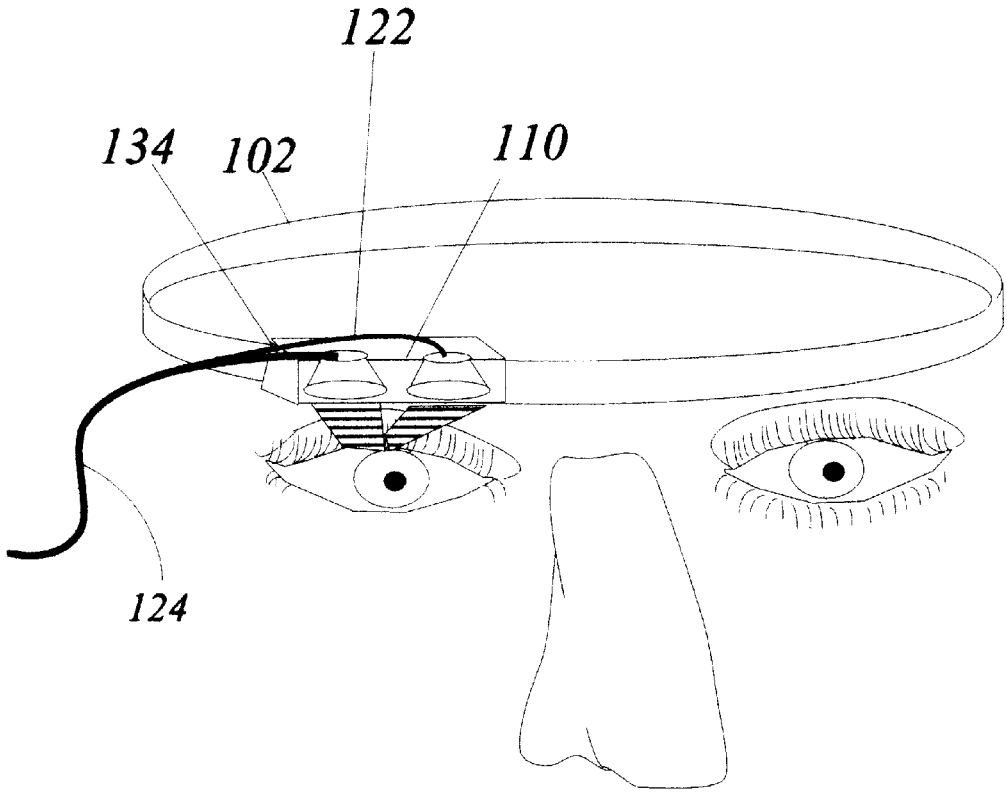
FIG. 6 perspective view of part of the third embodiment, shown beside a user face, indicating the operational position.
Figure 7:
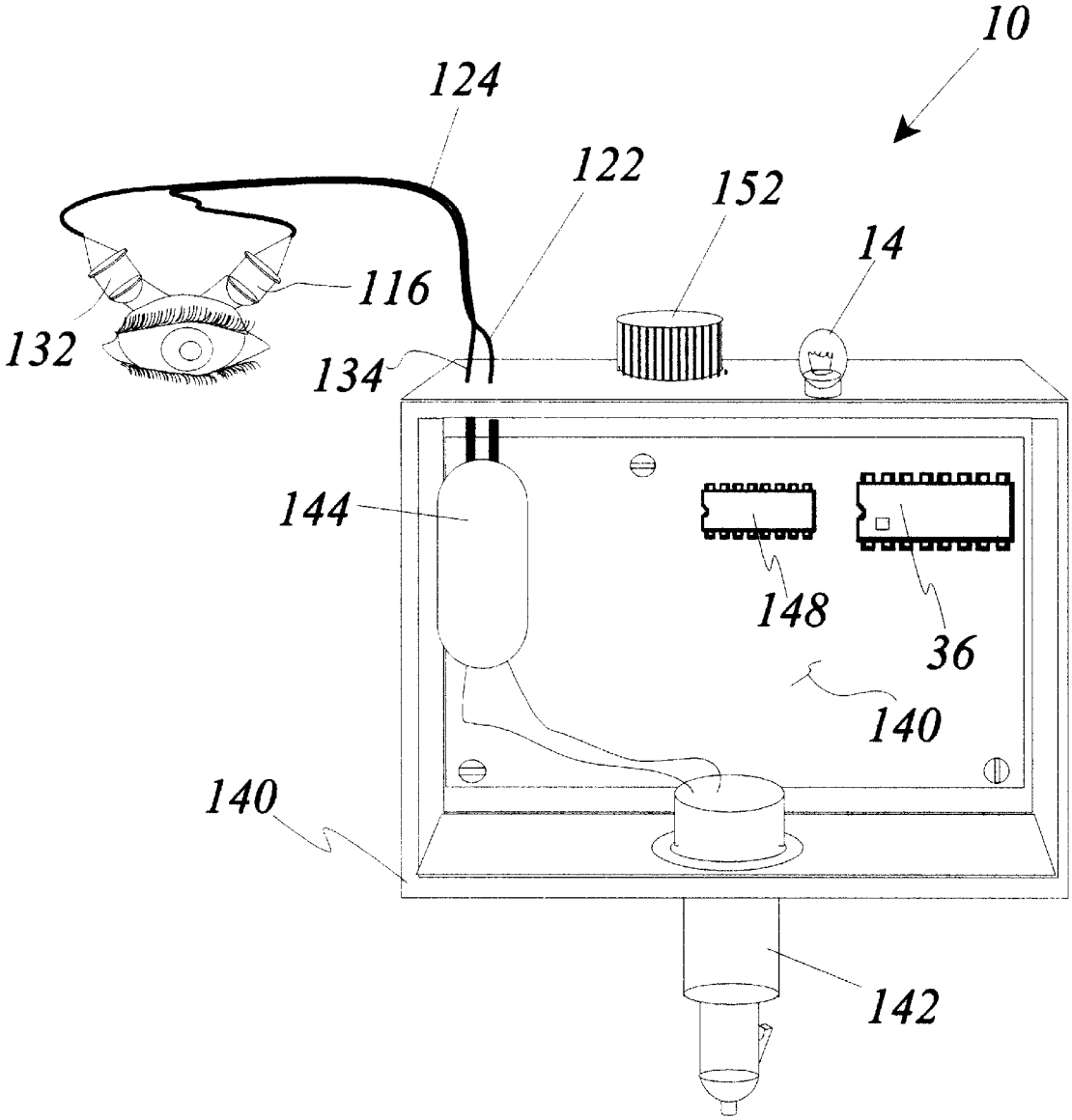
FIG. 7 is a perspective view of the entire third embodiment shown adjacent a system user eye and with the instrument module open to reveal the various mechanisms it contains.
Figure 8:
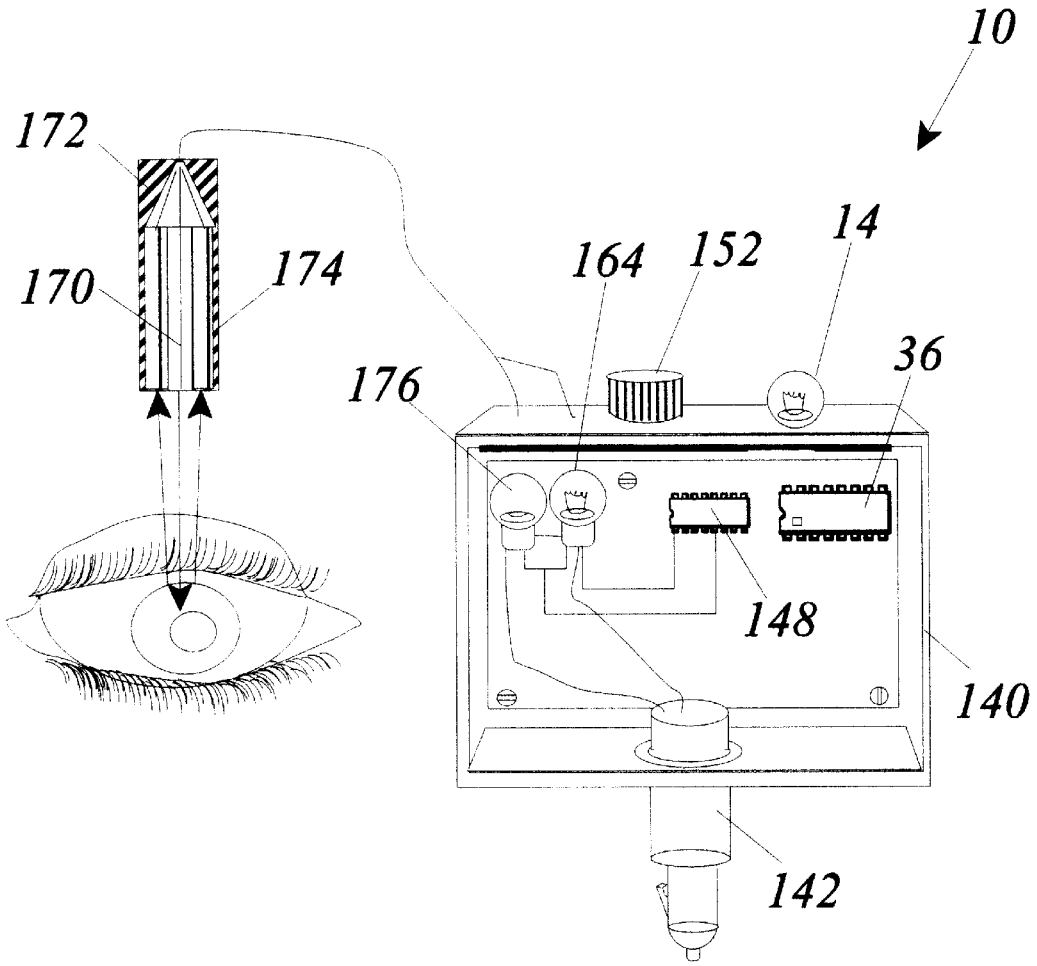
FIG. 8 is a view as in FIG. 7, but equipped with the alternative light wave rather than ultrasonic wave medium sending and receiving mechanisms.
Figure 9:
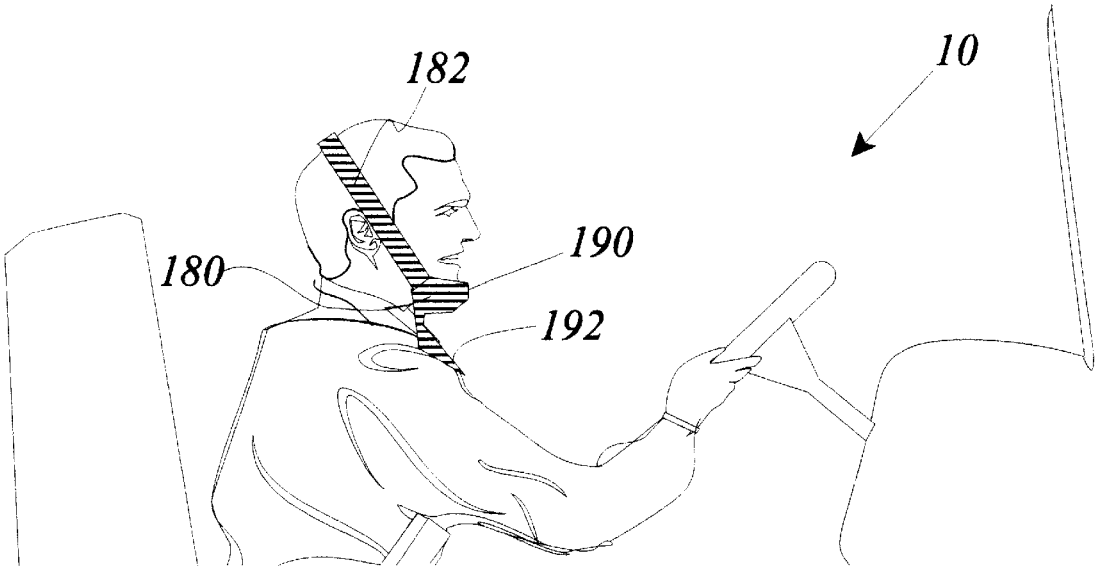
FIG. 9 is a side view of a system user seated before a vehicle steering wheel and wearing the fourth embodiment of the system including the hingedly connected chin cradle and head band with the pivot detection switch.
Figure 10:
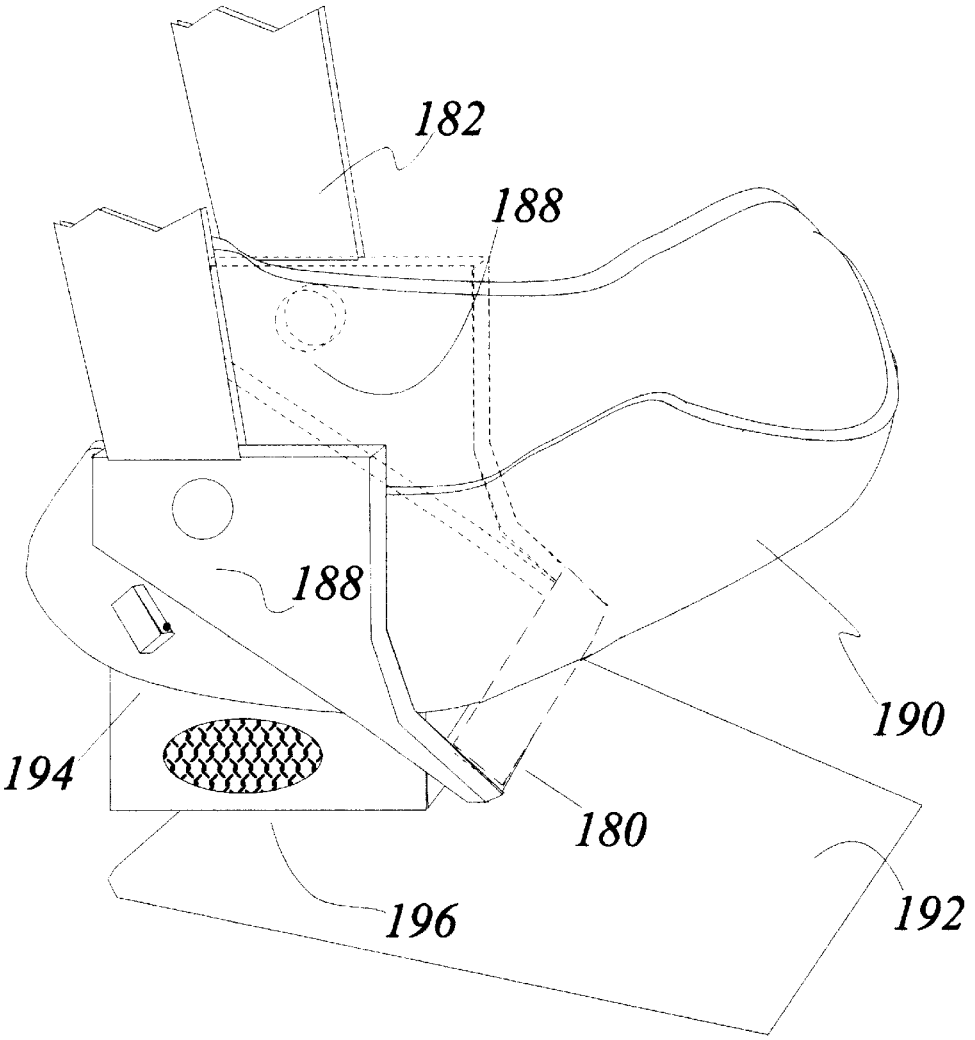
FIG. 10 is a close-up perspective view of the fourth embodiment, with the head band shown broken away, illustrating various structural details.

Referring to FIGS. 1–10, a system 10 is disclosed including sensing means 12 for sensing physiological changes indicating the onset of sleep, an alarm 14 and means for sounding alarm 14 upon detection of these changes to awaken the user.

First Preferred Embodiment

Sensing means 12 preferably takes the form of a wrist band 20 including a wrist band diameter adjustment mechanism 22 and an instrument housing 30. See FIGS. 1–3. Housing 30 includes two concave mating shell portions 32 and contains a battery 34, which is preferably a standard Nickel-Cadmium battery, a microprocessor 36, and a piezoelectric crystal 42 for sensing pressure variations between the user wrist and band 20. Housing 30 further contains a microphone 44 for sensing sounds generated by the pulsing heart of the user to determine the heart rate, a skin conductivity sensor 52 for measuring the amount of sweat generated, means for feeding electronic information in the form of an analog signal to the microprocessor 36 which in turn converts analog signals from the various sensors 42, 44 and 52 into digital form for processing with a built-in analog-to-digital converter (AD). Housing 30 also contains a beeper alarm 14.

Skin conductivity sensor 52 senses the amount of sweat present by measuring the skin electrical conductivity, which is a function of skin salinity. It is generally known that the amount of sweat produced by a person is directly related to his or her metabolic rate, and therefore to the level of alertness. Also it is generally known that the heart pulse-rate is related to the amount of energy the person is expending. These parameters indicate the physiological state of the person. It is known that, during the period immediately preceding sleep, a person experiences a reduction in perspiration, heart pulse-rate and blood pressure. Therefore, by calibrating the sensors 42, 44 and 52 to read these parameters, an exact determination can be made of the state of alertness of the person.

Filtering means not shown are preferably provided for filtering the analog signals before they reach microprocessor 36 to remove signals caused by sudden variations in wrist pressure against band 20, such as from sudden muscular movements, and to remove non-sinusoidal components of the repetitive heart and blood stream sounds. As a result, only signals caused by continuously varying pressure fluctuations are sensed and analyzed, to determine the time-dependent blood pressure variations.

Alarm 14 sounds only when one of these parameters reaches a preset threshold point, or only when two or more simultaneously reach threshold points. To sound alarm 14, the microprocessor 36 sends an alarm signal to activate beeper alarm 14.

Second Preferred Embodiment

The second embodiment detects sleep by monitoring the position of the head of the user. System 10 includes a laser beam 72 generating and directing assembly 70 having a base portion 74 which is secured in front of the user such as to the dash board 76 of a vehicle. See FIGS. 4 and 5. Assembly 70 directs laser beam 72 at the forehead of the user. Laser light is reflected from the forehead back to a receiving window (not shown) in assembly 70 and the intensity of the reflected laser light is measured. The intensity remains substantially constant unless the user head tilts sufficiently to present the hair or scalp to the beam 72, as would happen when the user begins to fall asleep. See FIG. 5. The hair scatters the reflected laser light and thus minimizes its reflected intensity, while the bare scalp reflects the light at angles different from the forehead to alter the intensity of the reflected laser light at the fixed receiving window location.

The change in reflected intensity triggers generation of an alarm signal to alarm 14, which causes alarm 14 to sound and awake the user. The duration of alarm 14 activation depends on the duration of the user head position in the tilted orientation. Therefore, should the driver move his or her head during a state of alertness, or should he or she consciously move his or her head into a position where the signal is generated, the alarm 14 deactivates after repositioning of the head into the upright position. Assembly 70 is also fitted with a turn-off switch 82 which is motion controlled. By waving the user hand in the path of beam 72 several times in quick succession, assembly 70 recognizes that the driver wishes to temporarily shift position and therefore shuts off momentarily to permit the change in position.

For some variations of this embodiment, system 10 not only sounds alarm 14 upon tilting of the user head but also deactivates the vehicle engine to stop the vehicle. System 10 optionally further activates emergency lights to indicate to the drivers of approaching vehicles that the vehicle in question is a potential hazard.

The wavelength and intensity of the laser beam 72 is selected to be harmless to the human eye. Beam 72 is preferably in the semi-invisible, far-infrared region.

Third Preferred Embodiment

The third embodiment detects sleep by monitoring the position of the eyelids of the user. When the eyelid stays closed for a pre-set length of time, such as five seconds, system 10 sounds beeper alarm 14. System 10 includes a headband 102 and a wave emitter and receiver structure 110 secured to headband 102 above one user eye. See FIG. 6. Structure 110 includes an ultra-sonic wave emitter 112 and a separate emitter and receiver. Structure 110 includes an emitter cone 116. A sending wave guide 122 directs sound energy generated by an instrument module 140, shown in FIG. 7, through conduit 124 in focused waves toward the user eye and eyelid. The sound waves bounce off the eye and eyelid and are then received by a receiver cone 132 and a receiving wave guide 134 contained in structure 110. The received sound waves are thereby transmitted back to instrument module 140 for analysis by conduit 124. Reflected sound is received by emitter and receiver structure 110 and transmitted to an analyzer through a sound conduit 124, made of materials which transmit sound with minimal loss.

Instrument module 140 is mechanically secured and electrically connected with a power plug 142 to a power source, such as a cigarette lighter port in a vehicle. See FIG. 7. Components within module 140 power up when plug 142 is inserted into the power source. A piezoelectric crystal and coil 144 creates a continuous stream of ultrasonic waves above the audible frequency. The amount of sound energy created by coil 144 is adjustable. As the system 10 powers up the user puts on head-band 102, and adjusts the emitter and receiver structure 110. See FIG. 6.

Coil 144 generates sound waves by converting an electrical signal into a vibration of a crystal element (not shown) in coil 144. Sound waves reflected by the eye or eyelid are converted back into an electrical signal by vibrating the crystal element. Once a sound wave is emitted by coil 144, coil 144 reverts back to a state of rest and awaits detection of an echo signal. The echo signal oscillates coil 144 and thereby generates an electrical signal measurable by microprocessor 36 and analogue-to-digital converter 148. When energy read from the received wave is a certain percentage of the energy emitted by the coil 144, microprocessor 36 sends a signal to an amplifier which delivers a large current to beeper alarm 14 to sound an audible alarm.

A wavelength and wave intensity adjustment device (not shown) is preferably provided in module 140 and is operated by turning knob 152. The user blinks his or her eyes while continuously adjusting the wavelength by rotating knob 152 to fine-tune the system 10 operation so that system 10 will detect blinks of a desired duration and emit an audible sound through beeper alarm 14.

A fiber-optic variation of system 10 is contemplated, in which a fiber optic wave guide 162 transmits light waves from a light emitter 164. See FIG. 8. Emitter 164 and a light receiver diode 176 replace coil 144, and wave guides 172 and 174 enter a concentric pair of fiber optic cables 170. See FIG. 8. Emitter 164 sends a light signal through fiber optic cable 170 which terminates at the central axis of structure 12 as wave guide 172. Light waves reflected off the user eye are carried co-axially into fiber optic waveguide 174, as indicated by the arrows in FIG. 8. The method of operation of a co-axial probe is disclosed in U.S. Pat. No. 5,004,755 issued to Michael M. Anthony, et al. Reflected light waves are received by diode 176 and converted into an electrical signal and processed by microprocessor 36 analogously to the above-discussed conversion of sound waves.

Fourth Preferred Embodiment

The fourth embodiment (FIGS. 9–10) detects sleep by monitoring the position of the head of the user. System 10 includes a pivot structure 180 with a head band 182, and a chin cradle 190 secured to a stabilizing chest plate 192 pivotally joined to pivot structure 180 with a hinge pin 188. A switch 194 is secured to chin cradle 190. As the user begins to sleep, his or her head tilts forward and pivot structure 180 pivots against switch 194 which activates an alarm sounding through a speaker 196. The user chin pivots within and relative to chin cradle 190.

A proximity magnetic sensor might equivalently be substituted for switch 194, which senses the position of chin cradle 190 relative to pivot structure 180. System 10 is constructed of light weight, sturdy material. Chin cradle 190 can also serve as a protective shield for the chin in the event of an accident.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A sleep detection and alarm system, comprising:

sensing means for sensing physiological changes in a user indicating the onset of sleep, an alarm means, and alarm activation means connected to said sensing means for sounding said alarm means upon detection of said changes by said sensing means to awaken the user, comprising a wrist band, an instrument housing mounted to said wrist band and containing a power source, a microprocessor, a piezoelectric crystal for sensing and generating electronic information concerning pressure variations between the user's wrist and said wrist band, and means for feeding said electronic information in the form of an analog signal to said microprocessor for processing and selectively sounding said alarm means.

2. A system according to claim 1, additionally comprising filtering means for filtering the analog signals before they reach said microprocessor for removing sudden variations and non-sinusoidal components of repetitive heart and blood stream sounds, such that only continuously varying signals are sensed and analyzed.

3. A sleep detection and alarm system, comprising:

sensing means for sensing physiological changes in a user indicating the onset of sleep, an alarm means, and alarm activation means connected to said sensing means for sounding said alarm means upon detection of said changes by said sensing means to awaken the user, comprising:

a wrist band an instrument housing mounted to said wrist band and containing a power source, a microprocessor, a microphone for sensing and generating electronic information concerning sounds generated by the user's heart to determine the user's heart rate, and means for feeding said electronic information in the form of an analog signal to said microprocessor for processing and selectively sounding said alarm means.

4. A system according to claim 3, additionally comprising filtering means for filtering the analog signals before they reach said microprocessor for removing sudden variations and non-sinusoidal components of repetitive heart and blood stream sounds, such that only continuously varying signals are sensed and analyzed.

5. A sleep detection and alarm system, comprising:

sensing means for sensing physiological changes in a user indicating the onset of sleep, an alarm means, and alarm activation means connected to said sensing means for sounding said alarm means upon detection of said changes by said sensing means to awaken the user, comprising a wrist band an instrument housing mounted to said wrist band and containing a power source, a microprocessor, a skin conductivity sensor for measuring and generating electronic information concerning the amount of sweat generated by the user's skin adjacent said housing, and means for feeding said electronic information in the form of an analog signal to said microprocessor for processing and selectively sounding said alarm means.

6. A system according to claim 5, additionally comprising filtering means for filtering the analog signals before they reach said microprocessor for removing sudden variations and non-sinusoidal components of repetitive heart and blood stream sounds, such that only continuously varying signals are sensed and analyzed.

7. A sleep detection and alarm system, comprising:

means for detecting closure of an eyelid of a user for a certain length of time, an alarm means, and means for sounding said alarm means upon detection of eyelid closure for said certain length of time, comprising a headband, a sound wave conduit, a sound wave emitter and receiver structure secured to said headband adjacent one eye of the user comprising an ultrasonic sound wave emitter including an emitter cone and an emitter wave guide for directing sound waves received through said conduit in focused waves toward the user's eye and eyelid, and a receiver cone and a receiving wave guide, wherein said sound waves are reflected off the user's eye and eyelid and received by said receiver cone and a receiving wave guide, whereby said reflected sound wave is transmitted back to means for analysis through said conduit.

8. A system according to claim 7, wherein said means for analysis is a module comprising:

a power plug for connection to a power source, a piezoelectric crystal and coil for creating a continuous stream of ultrasonic pulses, and a microprocessor for analyzing reflected sound signals and selectively sounding said alarm means.

9. A sleep detection and alarm system, comprising:

means for detecting closure of an eyelid of a user for a certain length of time, an alarm means, and means for sounding said alarm means upon detection of eyelid closure for said certain length of time, wherein said means for detecting closure of an eyelid comprises: a headband, a light conduit, a light wave emitter and receiver structure secured to said headband adjacent one eye of the user comprising a light wave emitter including an emitter cone and an emitter wave guide for directing light waves received through said conduit in focused waves toward the user's eye and eyelid, and a receiver cone and a receiving wave guide, wherein said light waves are reflected off the user's eye and eyelid and received by said receiver cone and a receiving wave guide, whereby said reflected light wave is transmitted back to means for analysis through said conduit.

10. A sleep detection and alarm system, comprising:

a torso mounting structure and means for removably securing said torso mounting structure relative to the user's torso, a head mounting structure and means for removably securing said head mounting structure relative to the user's head, pivot detection means detecting forward pivoting of said head mounting structure relative to said torso mounting structure of a certain extent, and alarm means operationally connected to said pivot detection means for sounding an alarm when said pivot detection means detects forward pivoting of said head mounting structure relative to said torso mounting structure of said certain extent.

11. A system according to claim 10, additionally comprising hinge means pivotally interconnecting said torso mounting structure and said head mounting structure, permitting said head mounting structure to pivot forwardly relative to said torso mounting structure as the user's head tilts forwardly relative to the user's torso.

12. A system according to claim 10, wherein said head mounting structure comprises a head band and head band base pivot structure.

13. A system according to claim 10, wherein said torso mounting structure comprises a chest support plate for resting on the user's chest and a neck plate extending upwardly from and connected to said chest support plate.

14. A system according to claim 13, wherein said pivot detection means comprises a switch secured to said neck plate in a position to be contacted and thereby operated by said head mounting structure as said head mounting structure pivots forwardly with the user's head.

* * * * *